US007165534B2

(12) United States Patent
Usui et al.

(10) Patent No.: US 7,165,534 B2
(45) Date of Patent: Jan. 23, 2007

(54) FUEL FEED SYSTEM

(75) Inventors: Satoshi Usui, Tokyo (JP); Hiroshi Odakura, Tokyo (JP); Toru Onose, Tokyo (JP); Atsuji Saito, Tokyo (JP); Masami Abe, Tokyo (JP); Hiroyuki Yamada, Tokyo (JP)

(73) Assignees: Hitachi, Ltd., Tokyo (JP); Hitachi Car Engineering Co, Ltd., Hitachinaka (JP)

( * ) Notice: Subject to any disclaimer, the term of this patent is extended or adjusted under 35 U.S.C. 154(b) by 267 days.

(21) Appl. No.: 10/274,034

(22) Filed: Oct. 21, 2002

(65) Prior Publication Data

US 2003/0164161 A1 Sep. 4, 2003

(30) Foreign Application Priority Data

Mar. 4, 2002 (JP) ..... 2002-057132

(51) Int. Cl.
*F02M 37/04* (2006.01)

(52) U.S. Cl. ..... 123/467; 123/456

(58) Field of Classification Search ..... 123/467, 123/447, 446, 456
See application file for complete search history.

(56) References Cited

U.S. PATENT DOCUMENTS 4,649,884 A * 3/1987 Tuckey ..... 123/457
4,951,636 A * 8/1990 Tuckey et al. ..... 123/497
5,575,262 A * 11/1996 Rohde ..... 123/467
5,617,827 A * 4/1997 Eshleman et al. ..... 123/456
5,896,843 A * 4/1999 Lorraine ..... 123/467
6,135,734 A * 10/2000 Isozumi et al. ..... 417/542
6,321,719 B1 * 11/2001 Schwegler ..... 123/467
6,360,722 B1 * 3/2002 Onishi ..... 123/467
6,418,909 B1 * 7/2002 Rossi et al. ..... 123/456
6,443,131 B1 * 9/2002 Bueser ..... 123/467
6,672,286 B1 * 1/2004 Miandoab et al. ..... 123/456

FOREIGN PATENT DOCUMENTS

JP 10-077927 3/1998
JP 2000-193186 7/2000
JP 2000-249019 9/2000
JP 2000-265926 9/2000

(Continued)

*Primary Examiner*—Carl S. Miller
(74) *Attorney, Agent, or Firm*—Crowell & Moring LLP

(57) ABSTRACT

A fuel feed system capable of feeding a fuel to fuel injection valves at a fuel pressure with improved stability is provided. A fuel feed system for an internal combustion engine including a fuel tank and a low-pressure pump for feeding the fuel in the fuel tank to fuel injection valves, is provided with a diaphragm type damper having a wave-shape cross section at a position in contact with the fuel. Also, in a high-pressure fuel feed pump including a pressurizing chamber for pressurizing the fuel, a plunger for pumping the fuel within the pressurizing chamber, an intake valve provided at a fuel inlet of the pressurizing chamber, a discharge valve provided at a fuel outlet of the pressurizing chamber, and a low-pressure chamber provided in an upstream of the intake valve, a mechanism for reducing fuel pressure pulsation is disposed in a space of the low-pressure chamber provided in the upstream of the intake valve, and a fuel pressure sensor for measuring the fuel pressure is mounted near the mechanism for reducing fuel pressure pulsation.

20 Claims, 9 Drawing Sheets

FOREIGN PATENT DOCUMENTS

| | | |
|---|---|---|
| JP | 2000-266183 | 9/2000 |
| JP | 2000-297725 | 10/2000 |
| JP | 2001-055961 | 2/2001 |
| JP | 2001-059466 | 3/2001 |
| JP | 2001-065427 | 3/2001 |
| JP | 2001-082290 | 3/2001 |
| JP | 2001-265925 | 9/2001 |

* cited by examiner

FUEL FEED SYSTEM

BACKGROUND OF THE INVENTION

The present invention relates to a fuel feed system for feeding fuel for fuel injection valves of an internal combustion engine.

Regarding such a fuel feed system, mechanisms utilizing a single diaphragm to reduce fuel pressure pulsation are disclosed in JP-A-2001-55961, JP-A-2001-59466, JP-A-2000-297725, JP-A-2000-266183, JP-A-2000-265926, JP-A-2000-249019, JP-A-2000-193186, and Japanese patent No. 3180948.

Moreover, methods utilizing a metal bellows as the mechanism to reduce fuel pressure pulsation are disclosed in JP-A-2001-82290 and JP-A-2001-59466.

Furthermore, methods utilizing a rubber diaphragm as the mechanism to reduce fuel pressure pulsation are disclosed in JP-A-2001-65427 and JP-A-2000-265925.

However, the inventors of the present invention have found that the above described prior embodiments have a following disadvantage. That is, when a single diaphragm is used as a mechanism to reduce fuel pressure pulsation, it becomes necessary to make the diaphragm large-sized to sufficiently suppress the pulsation because it has a low capacity of reducing fuel pressure pulsation.

SUMMARY OF THE INVENTION

It is an object of the present invention to provide a fuel feed system capable of feeding fuel into a fuel injection valve at a fuel pressure with improved stability.

To attain the above described object, the present invention provides a fuel feed system of an internal combustion engine comprising a fuel tank and a low-pressure pump for feeding the fuel in the fuel tank to a fuel injection valve, wherein a diaphragm type damper having a wave-shape cross section is provided at a position in contact with the fuel.

By this configuration, it is made possible to feed fuel to a fuel injection valve at a fuel pressure with improved stability. Moreover, it is possible to adjust the lift of the damper against the external pressure. Thereby, it is possible to provide a mechanism having a higher capacity of absorbing pulsation without upsizing. Thus, it becomes possible to feed fuel to a fuel injection valve at a fuel pressure with improved stability.

Other objects, features and advantages of the invention will become apparent from the following description of the embodiments of the invention taken in conjunction with the accompanying drawings.

DETAILED DESCRIPTION OF THE PREFERRED EMBODIMENT

The inventors have studied various methods of reducing fuel pressure pulsation and associated problems eventually obtaining following findings. First, at the time of using a single diaphragm as a mechanism for reducing fuel pressure pulsation, a problem arises in that the diaphragm must be made large-sized because of its low capacity of reducing fuel pressure pulsation. In addition to that, a fuel piping tends to be overloaded causing problems of durability or noise. Moreover, there arises a problem of erosion caused by cavitation in a pressurizing chamber of a high-pressure fuel feed pump.

Secondly, it was found that the use of a metal bellows as the mechanism to reduce fuel pressure pulsation would result in problems such as large-sizing of the mechanism and increase in costs. Moreover, it was also found that when a rubber diaphragm is used as the mechanism to reduce fuel pressure pulsation, stoppers and others would be needed. Providing a stopper would also cause a problem of large-sizing or increase in costs. It was also found that the use of a rubber diaphragm would be limited in a small range of fuel pressure because of its lack of durability, and therefore the fuel feed system would not be able to cope with variable fuel pressure.

Now, embodiments will be described hereafter.

(Embodiment 1)

Figure 1:
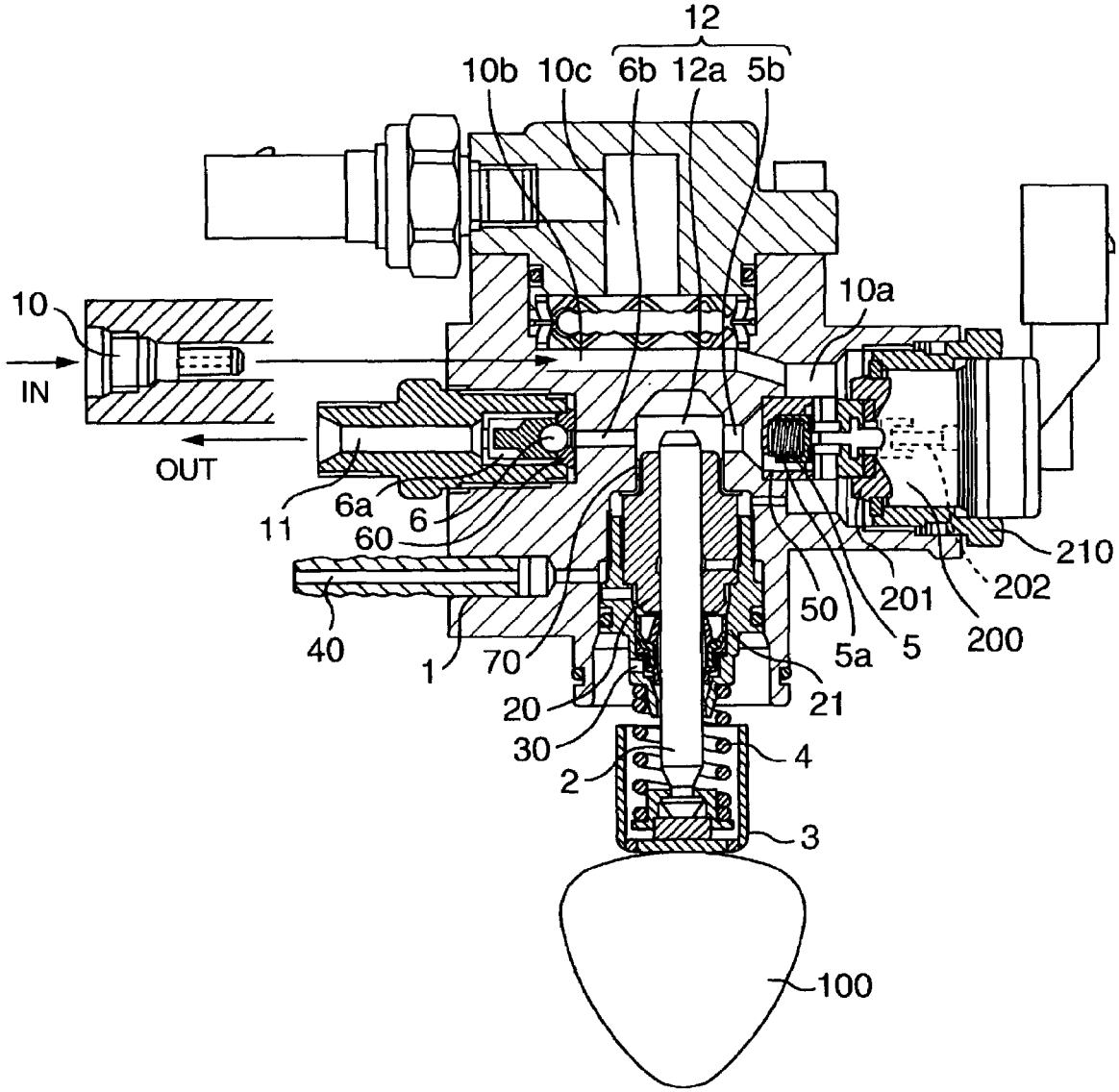
FIG. 1 is a vertical sectional view of an embodiment of the present invention.
Figure 2:
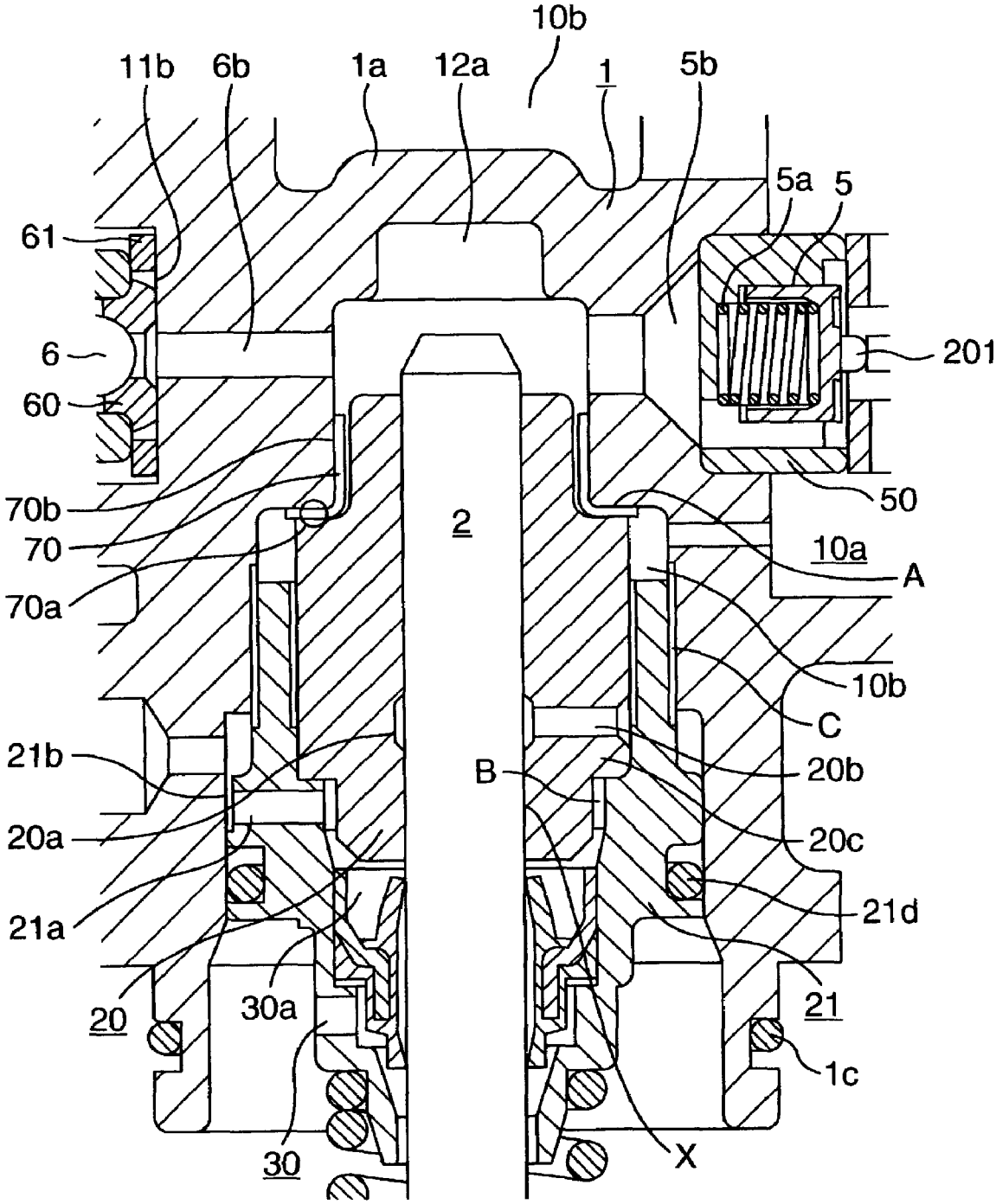
FIG. 2 is a partially enlarged sectional view of FIG. 1.
Figure 3:
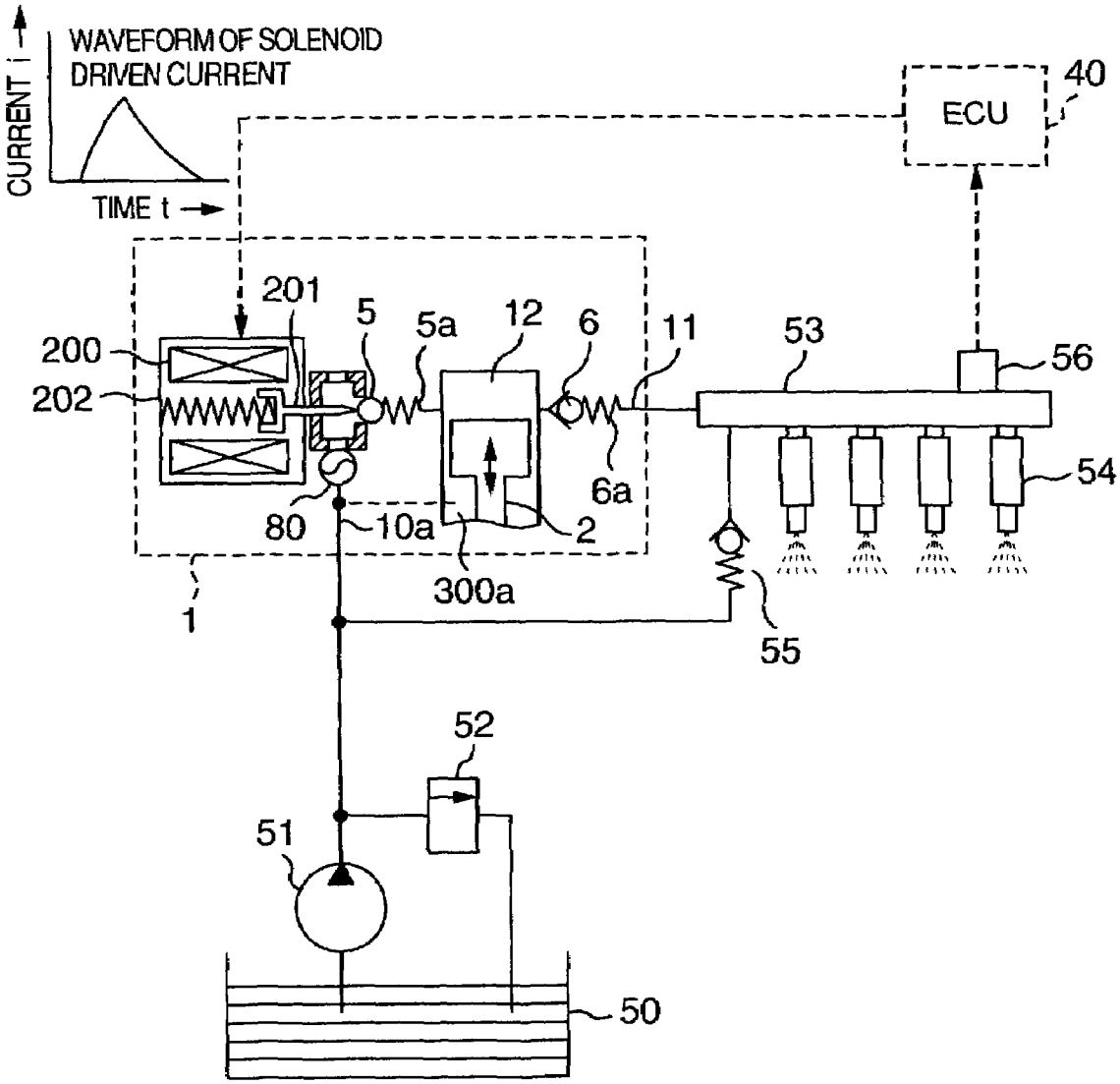
FIG. 3 shows the configuration of the fuel injection system.

Referring to FIGS. 1 to 3, a basic configuration and operation of a high-pressure fuel pump according to an embodiment will be described. FIG. 1 is a vertical sectional view of an entire pump; FIG. 2 is an enlarged view of an interior of the pump in FIG. 1; and FIG. 3 shows a configuration of a fuel injection system.

A pump body 1 is formed with a fuel inlet passage 10, a discharge passage 11, and a pressurizing chamber 12. The inlet passage 10 and the discharge passage 11 are provided with an intake valve 5 and a discharge valve 6 respectively; each of which is held being urged in one direction by a spring 5*a* and a spring 6*a* respectively thereby acting as a check-valve to limit the direction of the fuel flow. The pressurizing chamber 12 is formed of a pump chamber 12 through which a pressurizing member, or a plunger 2 slides, an inlet 5*b* in communication with the intake valve 5, and an outlet 6*b* in communication with the discharge valve 6.

Further, in an inlet chamber 10*a*, a solenoid 200 is mounted on the pump body 1, and the solenoid 200 is arranged with an engaging member 201 and a spring 202. The engaging member 201 is subject to an urging force of the spring 202 in the direction of opening the intake valve 5 when the solenoid 200 is OFF. Since the urging force of the spring 202 is configured to be greater than that of the intake valve spring 5*a*, the intake valve 5 is kept open when the solenoid 200 is OFF as shown in FIGS. 1 and 2. The fuel is introduced from a tank 50 to a fuel inlet port of the pump body 1 with a low-pressure pump 51 at a constant pressure regulated by a pressure regulator 52. Thereafter, the fuel is pressurized in the pump body 1 to be fed to the common rail 53 through the fuel discharge port. The common rail 53 is equipped with an injector 54, a relief valve 55, and a pressure sensor 56. The injector 54 is installed according to the number of the engine cylinders, and activated by the signal from an engine control unit (ECU) 40. Also, the relief valve 55 is opened when the pressure inside the common rail 53 exceeds a predetermined value to prevent the failure of the piping system.

According to the above described configuration, the operation will be described hereafter.

A lifter 3 provided at the lower end of the plunger 2 is pressed against a cam 100 with a spring 4. The plunger 2 is slidably held in a cylinder 20 and undergoes reciprocating motion driven by a cam 100 rotated by an engine camshaft or others to change the volume inside the pressurizing chamber 12.

Also, at a lower end of the cylinder 20 in the drawing, there is provided a plunger seal 30 for preventing the fuel from flowing out in the direction of the cam 100.

When the intake valve 5 is closed during the compression stroke of the plunger 2, the internal pressure of the pressurizing chamber 12 goes up, and thereby the discharge valve 6 is automatically opened to feed the fuel under pressure to the common rail 53.

While the intake valve 5 is automatically opened when the pressure of the pressurizing chamber 12 becomes lower than that of the fuel inlet port, the closing of the valve is determined by the operation of the solenoid 200.

When the solenoid 200 is kept in the ON (current flow) state, it generates an electromagnetic force greater than the urging force of the spring 202, and thereby pulls the engaging member 201 toward the solenoid 200 causing the engaging member 201 to be separated from the intake valve 5. In this state, the intake valve 5 acts as an automatic valve that opens and closes in synchronous with the reciprocating motion of the plunger 2. Therefore, during the compression stroke, the intake valve 5 is closed and thus the fuel corresponding to the volume decrement in the pressurizing chamber 12 is fed to the common rail 53 under pressure opening the discharge valve 6 by force.

On one hand, when the solenoid 200 is kept in the OFF state (no current flow), the engaging member 201 is brought into engagement with the intake valve 5 by the urging force of the spring 202 holding the intake valve 5 in an open state. Therefore, even during the compression stroke, the pressure of the pressurizing chamber 12 is kept as low as that of the fuel inlet port. This will prevent the discharge valve 6 from being opened thereby causing the fuel corresponding to the volume decrement in the pressurizing chamber 12 to be returned toward the fuel inlet port through the intake valve 5.

Also, when the solenoid 200 is turned ON in the middle of the compression stroke, the fuel is forced to flow into the common rail 53 from that moment. Moreover, upon start of fuel feed under pressure, since the pressure in the pressurizing chamber 12 increases, the intake valve 5 is kept closed even if the solenoid 200 is turned OFF, and automatically opens in synchronous with the start of the intake stroke.

Figure 4:
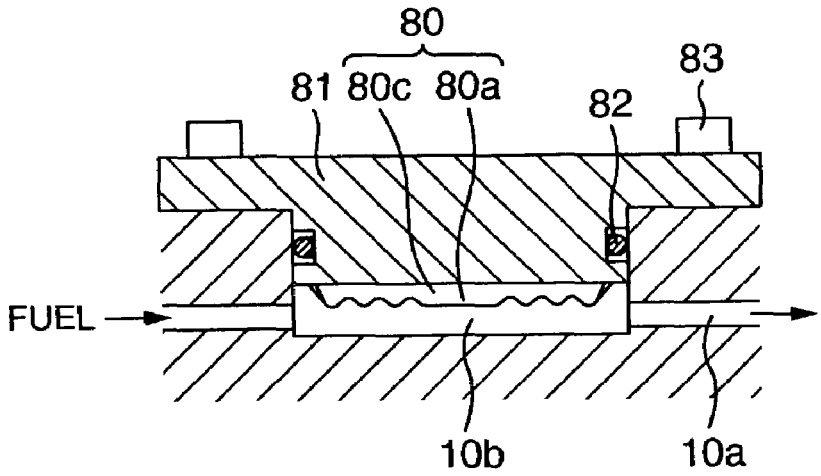
FIG. 4 is a partially enlarged sectional view of an embodiment.

Next, the mechanism to reduce fuel pressure pulsation will be described referring to FIG. 4. FIG. 4 is an enlarged view of the mechanism to reduce fuel pressure pulsation.

A diaphragm type damper 80 composing of a diaphragm 80*a* having a wave-shape cross section and gas 80*c* are provided between the fuel intake passage 10 and the low-pressure chamber 10*a* as the mechanism for reducing fuel pressure pulsation. The gas 80*c* is sealed up in the space formed of a damper case 81 and the diaphragm 80*a*. The damper case 81 is secured by setscrews 83 and the fuel is sealed with an O-ring 82.

This configuration allows the adjustment of the amount of lift of the damper against the outer pressure, making it possible to place a mechanism having a high capacity of absorbing pressure pulsation without the need of large-sizing, and to feed the fuel to the fuel injection valve at a fuel pressure with improved stability.

Also, use of a metal as the diaphragm material will increase the pressure resistance of the diaphragm, making it possible to achieve a fuel feed system providing with a damper having a wide range of working fuel pressure.

Next, another embodiment will be described referring to FIGS. 5 to 8.

As a mechanism for reducing fuel pressure pulsation, there is provided between the fuel passage 10 and the low-pressure chamber 10*a*, a diaphragm type damper 80 formed of two diaphragms 80*a* and 80*b* between which gas 80*c* is enclosed.

By this configuration, it is made possible to achieve a fuel feed system on which a compact pulsation absorption mechanism is mounted.

Figure 5:
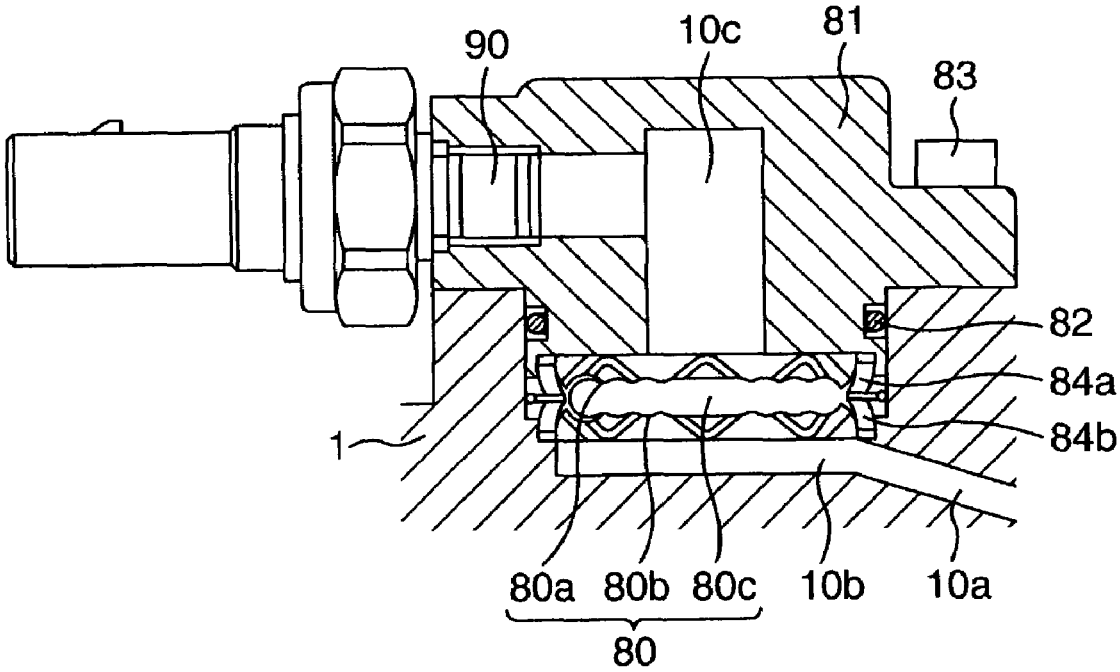
FIG. 5 is a partially enlarged sectional view of an embodiment.

In FIG. 5, the two diaphragms 80*a*, 80*b* have a substantially convex shape and are connected with each other so as to form a convex lens shape.

By this configuration, it is made possible to achieve a fuel feed system on which a damper of a lower cost and a smaller size is mounted.

Figure 6:
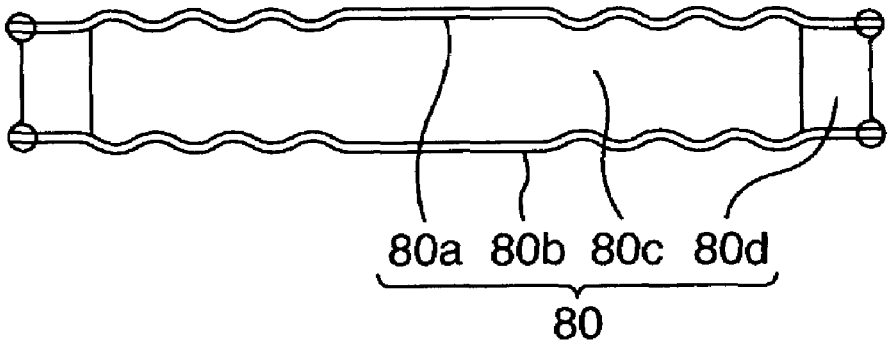
FIG. 6 is a partially enlarged sectional view of an embodiment.

Also shown in FIG. 6 is a diaphragm type damper formed by connecting two diaphragms together with an annular member placed between the two diaphragms.

This configuration allows a higher degree of freedom in the diaphragm configuration, thereby making it possible to achieve a fuel feed system providing with a mechanism for absorbing fuel pressure pulsation which is smaller in size and higher in pulsation absorbing capacity.

In FIGS. 5, 6, each of the two diaphragms 80*a*, 80*b* has a wave-shape cross section.

This configuration allows the selection of the capacity and range of pressure pulsation absorption by selecting the sectional shape to achieve a fuel feed system on which a low cost, compact damper is mounted.

Figure 7:
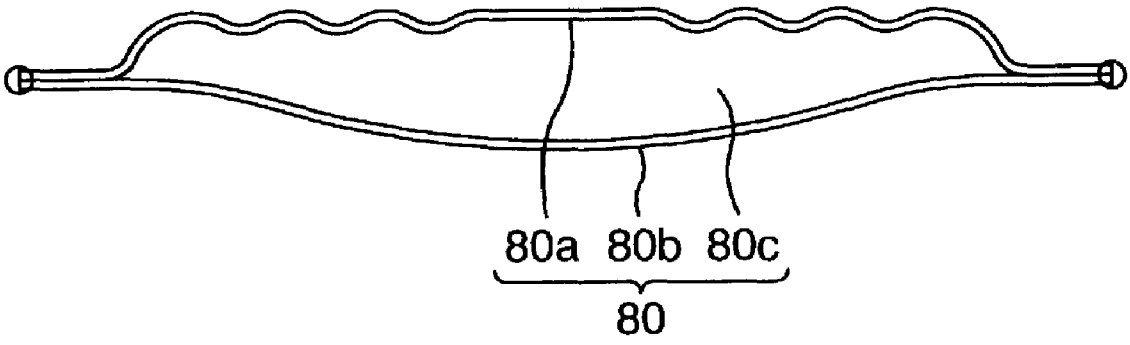
FIG. 7 is a partially enlarged sectional view of an embodiment.
Figure 8:
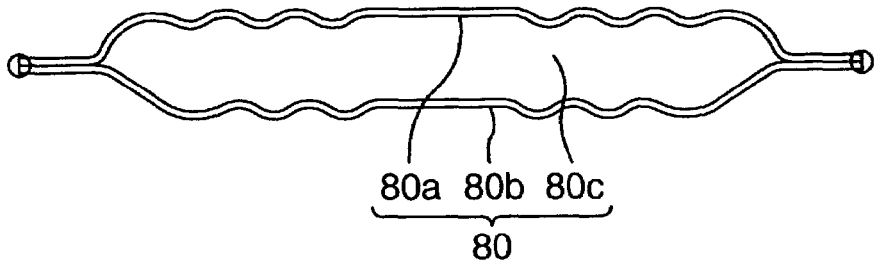
FIG. 8 is a vertical sectional view of an embodiment.
Figure 9:
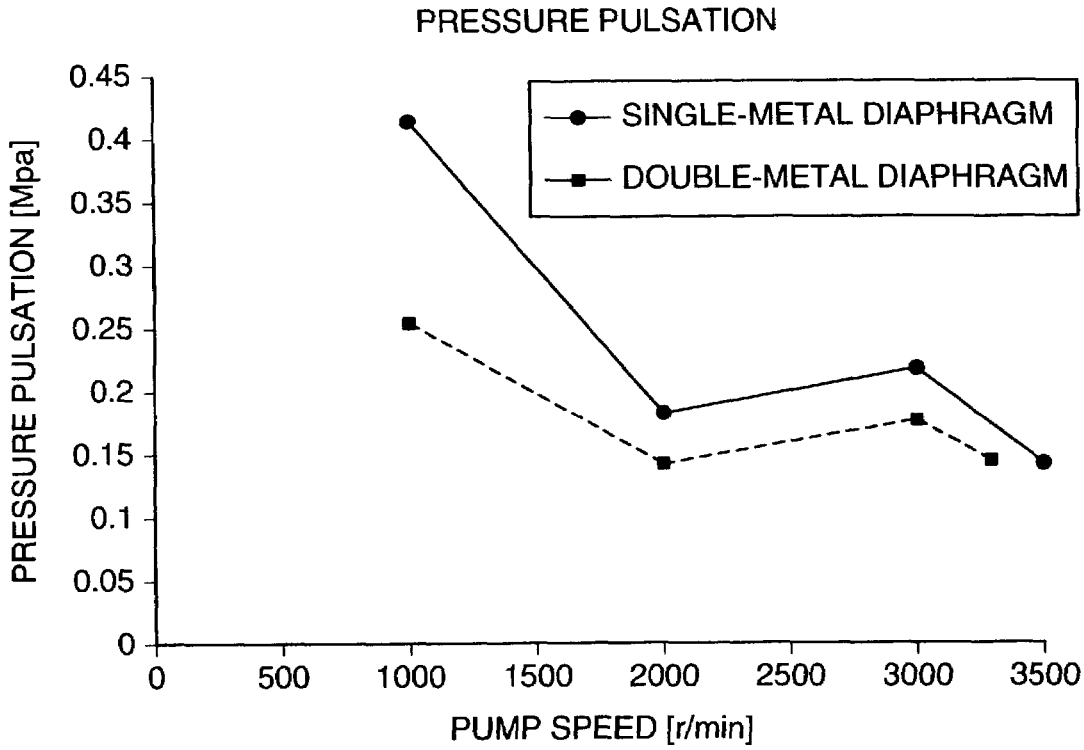
FIG. 9 is a diagram to show a comparison of a fuel pressure absorbing capacity between a damper according to one embodiment and a single metal diaphragm type damper.

Also, arrangement may be such that only one of the two diaphragms 80*a*, 80*b* has a wave-shape cross section as shown in FIG. 7 or the two diaphragms 80*a*, 80*b* have different wavelike shapes in cross section as shown in FIG. 9.

By this configuration, the two diaphragms 80*a*, 80*b* can reduce fuel pressure pulsation with different characteristics respectively, and thus it is made possible to achieve a fuel feed system comprising an absorption mechanism for fuel pressure pulsation with a smaller size and a higher pulsation absorption capacity.

Moreover, forming the two diaphragms 80*a*, 80*b* with a metal will enhance the durability of the diaphragm, making it possible to achieve a fuel feed system providing with a damper having a smaller size and a broader range of working fuel pressure.

Thus, the system can cope with variable fuel pressures.

Furthermore, by welding the outer peripheries of the above described two diaphragms 80*a*, 80*b*, it is made possible to achieve a fuel feed system on which a damper of a smaller size and a lower cost is mounted.

Further, by arranging the gas pressure sealed up between the two diaphragms so that it is not smaller than the minimum working fuel pressure and not greater than the maximum working fuel pressure, it is made possible to achieve a fuel feed system composing of a damper capable of effectively reducing fuel pressure pulsation within the range of working fuel pressure.

Further, as shown in FIG. 5, the damper case 81 is secured to the housing 1 with a setscrew 83, thereby allowing the diaphragm type damper 80 to be fixed. Fuel chambers 10*b*, 10*c* are provided on both sides of the diaphragm type damper 80 and the fuel is sealed with an O-ring 82.

By this configuration, it is made possible to make the diaphragm type damper 80 sufficiently absorb the fuel pressure pulsation.

FIG. 9 is a diagram showing the comparison of the pulsation absorption capacity between a single-metal diaphragm type damper and a double-metal diaphragm type damper. The horizontal axis represents the rotational speed of the pump cam 100 and the vertical axis represents the fuel pressure pulsation produced within a fuel pipe. The solid line represents the fuel pressure pulsation according to the present embodiment, and the dotted line represents the fuel pressure pulsation of a single metal diaphragm type damper.

The result shows that the configuration according to the present embodiment provides lower fuel pressure pulsation.

Therefore, it is possible to reduce the load on the fuel piping, thereby improving its durability and reducing the noise level of the fuel feed system.

Moreover, it is possible to restrict the occurrence of cavitation in the pressurizing chamber of a high-pressure fuel feed pump.

Also, as shown in FIG. 5, the diaphragm type damper 80 may be secured by means of a damper case 84 via elastic bodies 84*a*, 84*b* having a wavelike shape.

This configuration allows the diaphragm type damper 80 to be secured with an appropriate force, and the fuel to be delivered on both sides of the damper, thus making it possible to achieve a fuel feed system in which the diaphragm type damper would not be broken due to an inappropriate force and the fuel pressure pulsation would be sufficiently absorbed by the diaphragm type damper 80.

The elastic body may be composed of one elastic body, either 84*a* or 84*b*.

Further, a fuel pressure sensor 90 for measuring the fuel pressure may be mounted on the case 81 for securing the diaphragm type damper 80 as shown in FIG. 5.

This configuration makes it possible to achieve a high-pressure fuel feed pump of a smaller size, a lower cost, and a stable discharge capability in which a failure of the mechanism for reducing fuel pressure pulsation will be easily detected.

It is also possible to achieve a high-pressure fuel feed pump capable of accurately detecting the fuel pressure at the inlet of the high-pressure fuel feed pump with a pressure sensor.

(Embodiment 2)

Next, another embodiment will be described referring to FIGS. 10, 11.

Figure 10:
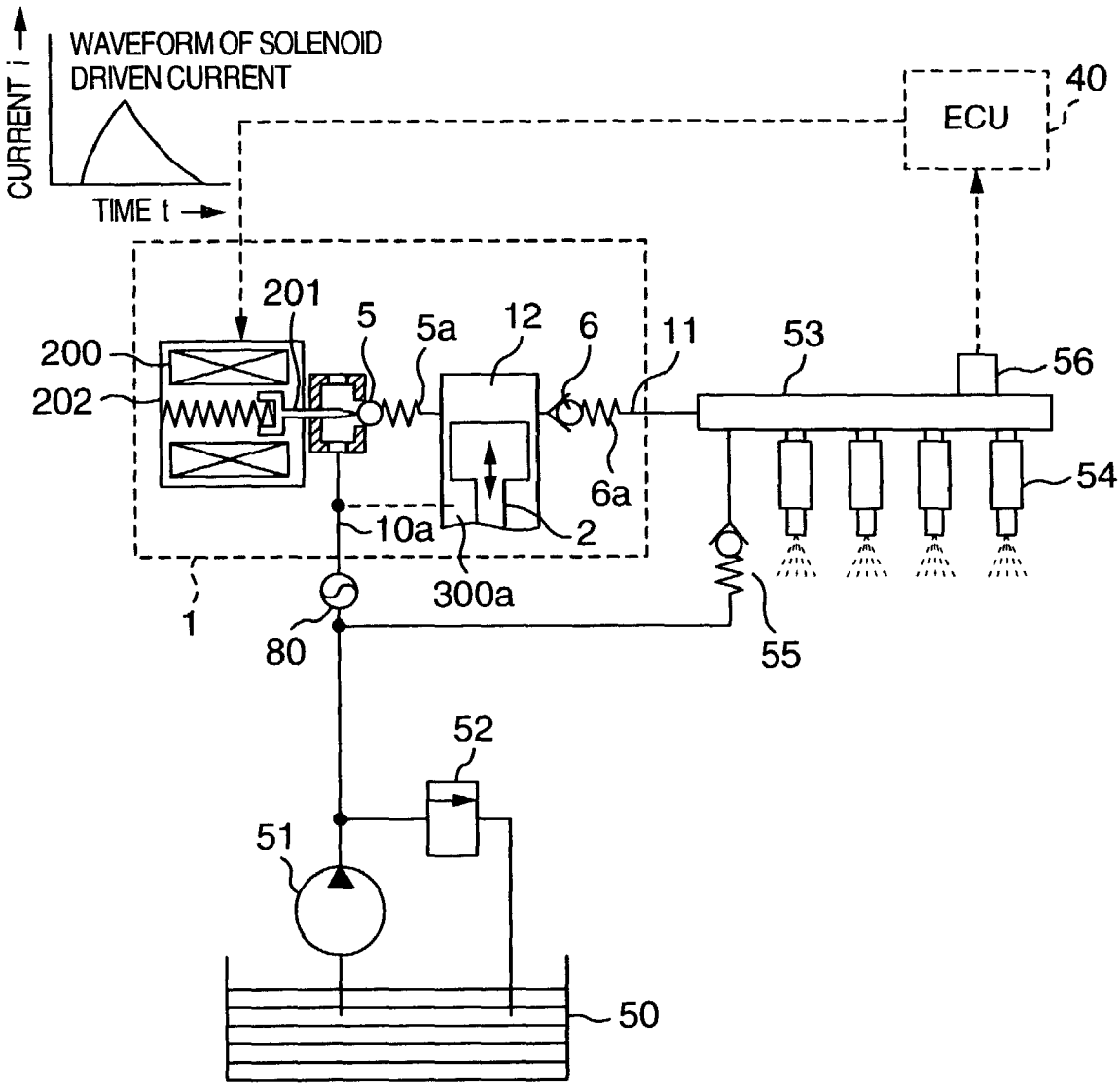
FIG. 10 shows a configuration of a fuel injection system according to an embodiment.

FIG. 10 shows a configuration in which the mechanism for reducing fuel pressure pulsation shown in FIG. 3 is placed in the low-pressure fuel passage upstream from the high-pressure fuel feed pump.

This configuration allows the low pressure pulsation of the fuel to be fed under pressure to the high-pressure fuel feed pump to be effectively reduced by means of a compact, low-cost damper, thereby making it possible to achieve a fuel feed system having a high-pressure fuel feed pump with the capability of stable discharge.

Figure 11:
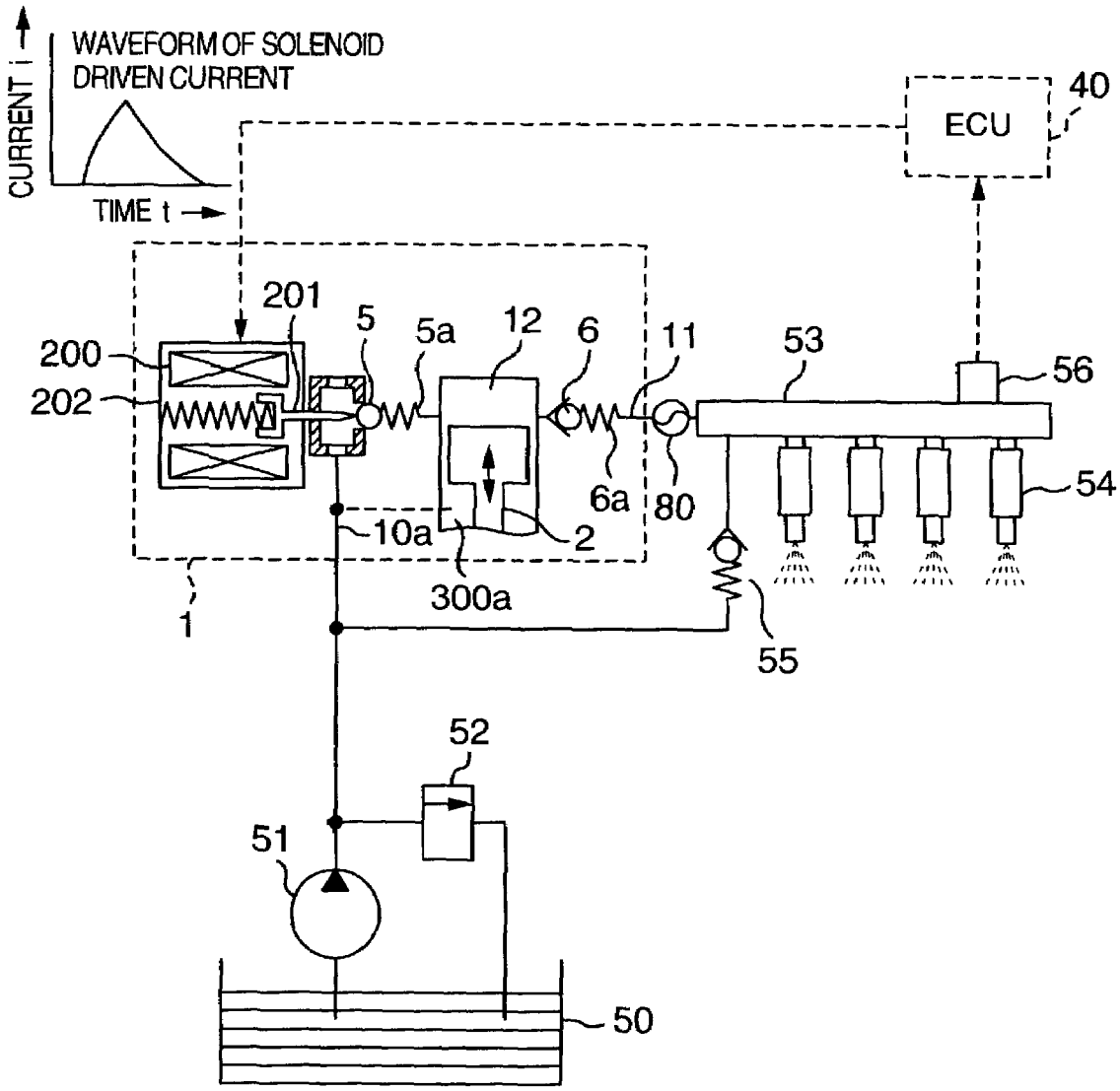
FIG. 11 shows the configuration of the fuel injection system according to an embodiment.

FIG. 11 shows a configuration in which the mechanism for reducing fuel pressure pulsation shown in FIG. 3 is placed in the high-pressure fuel passage downstream from the high-pressure fuel feed pump.

This configuration allows the pulsation of high-pressure fuel to be effectively reduced with a compact, low-cost damper, thereby making it possible to achieve a fuel feed system capable of feeding the fuel under pressure to the fuel injection valve at a fuel pressure with improved stability.

Figure 12:
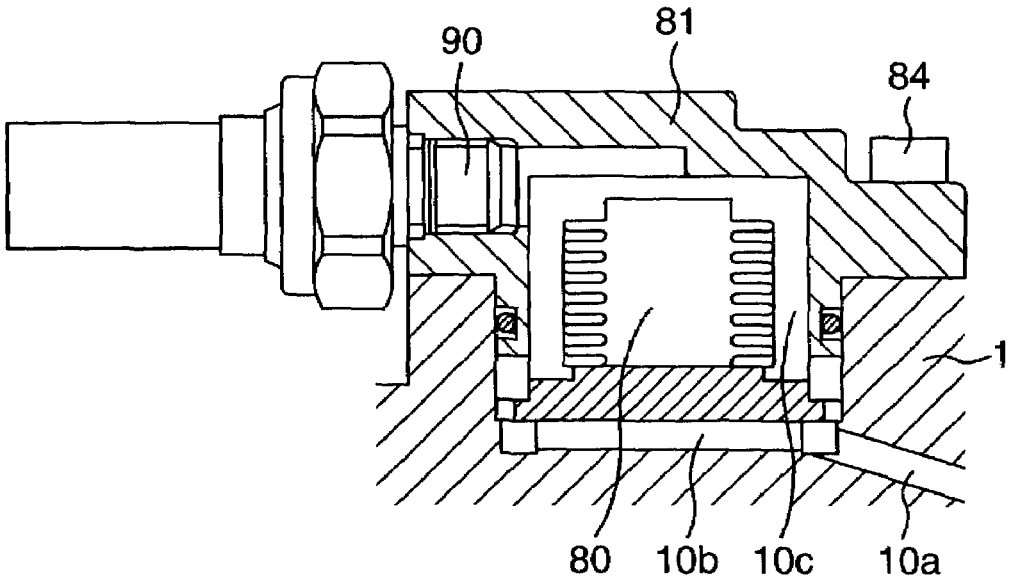
FIG. 12 is a partially enlarged sectional view of an embodiment.

Moreover, use of a metal bellows type damper 80 shown in FIG. 12 as the mechanism for reducing fuel pressure pulsation allows formation of a fuel chamber 10*c* by means of the case 81 to be used for securing the damper, thereby making it possible to achieve a high-pressure fuel feed pump in which a fuel pressure sensor 90 is readily attached to the case.

(Embodiment 3)

Figure 13:
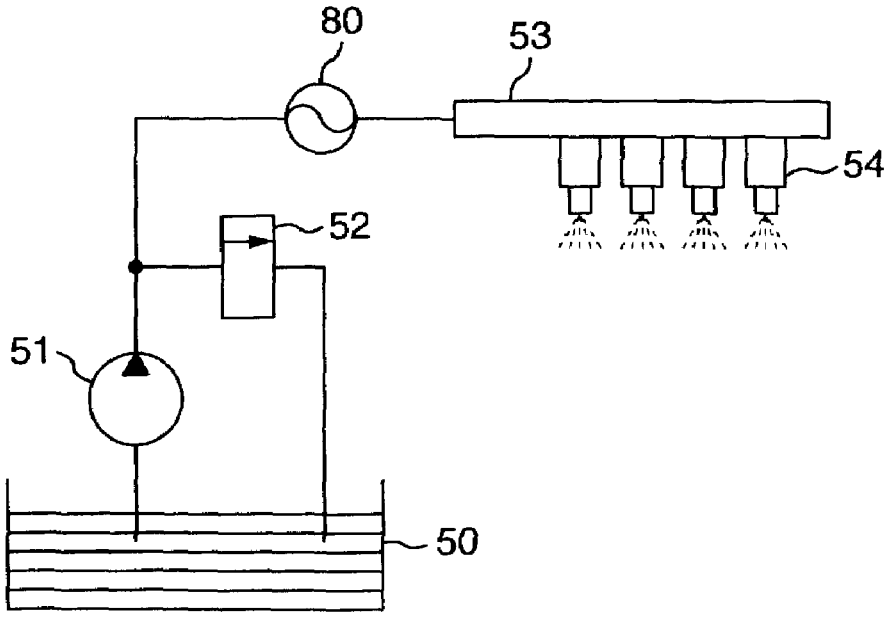
FIG. 13 shows the configuration of a fuel injection system.

Now still another embodiment will be described. In FIG. 13, there is shown a fuel feed system for an internal combustion engine comprising a fuel tank 50 and a low-pressure pump 51 for feeding the fuel in the fuel tank to a fuel injection valve, wherein a mechanism 80 for reducing fuel pressure pulsation is provided and secured with a cover, and a fuel chamber is provided inside the cover.

This configuration allows the mechanism for reducing fuel pressure pulsation to be secured with a simple structure, making it possible to achieve a compact and low-cost fuel feed system.

According to the embodiment described so far, forming the above described diaphragm type damper for a fuel feed system of a metal allows the durability of the diaphragm to be enhanced, making it possible to achieve a fuel feed system composing of a damper having a wide range of working fuel pressure.

Also, in a fuel feed system for an internal combustion engine including a fuel tank and a low-pressure pump for feeding the fuel in the fuel tank to the fuel injection valve, by providing a diaphragm type damper in which gas is sealed up inside between two diaphragms as the mechanism for reducing fuel pressure pulsation, it is made possible to achieve a fuel feed system including a compact pulsation absorption mechanism.

Further, by configuring the diaphragm to be a substantially convex shape and connecting two diaphragms forming a shape like a convex lens, it is made possible to achieve a fuel feed system including a damper of a lower cost and a smaller size.

Further, by forming a diaphragm type damper by connecting two diaphragms via an annular member placed between the diaphragms, a higher degree of freedom is allowed in the diaphragm configuration, thereby making it possible to achieve a fuel feed system having a fuel pressure pulsation absorbing mechanism that is smaller in size and higher in capacity of absorbing pulsation.

Further, by providing a diaphragm type damper in which at lest one of the two diaphragms has a wave-shape cross section, the capacity and range of pulsation absorption can be selected by selecting the cross section shape, thereby making it possible to achieve a fuel feed system including a compact, low-cost damper.

Further, forming the diaphragm with a metal diaphragm will enhance the pressure resistance of the diaphragm, thereby making it possible to achieve a fuel feed system including a damper having a smaller size and a broader range of working fuel pressure. This will allow the fuel feed system to cope with variable fuel pressures.

Furthermore, by welding the outer peripheries of the above described two diaphragms, it is made possible to achieve a fuel feed system comprising a damper of a smaller size and a lower cost.

Further, by arranging the gas pressure sealed up between the two diaphragms so that it is not smaller than the minimum working fuel pressure and not greater than the maximum working fuel pressure, it is made possible to achieve a fuel feed system including a damper capable of effectively reducing fuel pressure pulsation within the range of working fuel pressure.

Further, by providing fuel chambers on both sides of the two dampers, it is made possible to achieve a fuel feed system in which the damper effectively absorbs the fuel pressure pulsation. By doing so, it is also made possible to reduce the load on the fuel piping thereby improving its durability and reducing the noise level. Moreover, it becomes possible to restrict the occurrence of cavitation in the pressurizing chamber of a high-pressure fuel feed pump.

By securing the damper via an elastic body of a wavelike shape, the damper can be secured with an appropriate force making it possible to achieve a fuel feed system capable of delivering the fuel on both sides of the damper.

By providing a high-pressure fuel feed pump for pressurizing the low-pressure fuel from the low-pressure pump to a high pressure to feed the fuel to the fuel injection valve, and placing the diaphragm type damper in the low-pressure fuel passage upstream from the high-pressure fuel feed pump, it is made possible to effectively reduce low-pressure pulsation of the fuel to be fed under pressure into the high-pressure fuel feed pump by means of a compact, low-cost damper. It also becomes possible to achieve a fuel feed system comprising a high-pressure fuel pump with an enhanced discharge stability.

By providing a high-pressure fuel feed pump for pressurizing the low-pressure fuel from the low-pressure pump to a high-pressure to feed the fuel to the fuel injection valve, and placing the diaphragm type damper in the high-pressure fuel passage downstream from the high-pressure fuel feed pump, it is made possible to effectively reduce high-pressure pulsation of the fuel with a compact, low-cost damper, and therefore to achieve a fuel feed system capable of feeding the fuel under pressure to the fuel injection valve at a fuel pressure with improved stability.

Further, by providing a high-pressure fuel feed pump for pressurizing the low-pressure fuel from the low-pressure pump to a high-pressure to feed the fuel to the fuel injection valve, and placing the diaphragm type damper in a low-pressure chamber which is placed upstream from the intake valve of the high-pressure fuel feed pump, it is made possible to achieve a high-pressure fuel feed pump which is of a smaller size and a lower cost, and can stably discharge fuel.

Also in a high-pressure fuel feed pump comprising a pump body having a pressurizing chamber for pressurizing the fuel, a plunger for feeding the fuel by force in the pressurizing chamber, an intake valve provided in the fuel inlet of the pressurizing chamber, a discharge valve provided at the fuel outlet of the pressurizing chamber, and a low-pressure chamber provided in the upstream of the intake valve, by arranging a mechanism for reducing fuel pressure pulsation in a space of the low-pressure chamber provided in the upstream of the intake valve, and mounting a fuel pressure sensor for measuring the fuel pressure near the mechanism for reducing fuel pressure pulsation, it is made possible to achieve a high-pressure fuel feed pump which will not be affected by the pressure loss in the passage between the mounting part of the fuel pressure sensor and the inlet of the high-pressure pump, and in which the fuel pressure at the inlet of the high-pressure fuel feed pump can be measured with the pressure sensor with an improved accuracy.

Further, by mounting the fuel pressure sensor for measuring the fuel pressure to the case with which the mechanism for reducing fuel pressure pulsation is secured, it is made possible to achieve a smaller size and a lower cost as well as a stable fuel discharge of the high-pressure fuel pump. Since there will be no absorption of the fuel pressure pulsation between the mounting part of the fuel pressure sensor and the mechanism for reducing fuel pressure pulsation, it is possible to achieve a high-pressure fuel feed pump in which a failure of the mechanism for reducing fuel pressure pulsation will be easily detected.

Further, by utilizing a metal bellows type damper as the mechanism for reducing fuel pressure pulsation, a fuel chamber can be provided by means of the case with which the damper is secured. By this configuration, it is made possible to achieve a high-pressure fuel feed pump in which the above described sensor can be easily attached to the case.

Further, by utilizing a diaphragm type damper as the mechanism for reducing fuel pressure pulsation, a fuel chamber can be formed by utilizing the case with which the damper is secured, making it possible to downsize the case. By this configuration, it is made possible to attach the fuel pressure sensor to the case with ease, and thus achieve a compact, low-cost high-pressure fuel feed pump.

Further, in a fuel feed system of an internal combustion engine comprising a fuel tank and a low-pressure fuel pump for feeding the fuel in the fuel tank to a fuel injection valve, by providing a mechanism for reducing fuel pressure pulsation, securing the mechanism to the housing with a cover, and providing a fuel chamber inside of the cover, it is made possible to secure the mechanism for reducing fuel pressure pulsation with a simple structure. Thus, it is made possible to achieve a compact, low-cost system.

According to the above described embodiments, it is possible to provide following configurations.

A fuel feed system for an internal combustion engine comprising a fuel tank and a low-pressure pump for feeding the fuel in the fuel tank to a fuel injection valve, wherein a mechanism for reducing fuel pressure pulsation is provided, the mechanism is secured to a housing by means of a cover, and a fuel chamber is provided inside the cover.

A fuel feed device comprising: a plunger driven to and from by a reciprocating drive unit; a fuel pressurizing chamber in communication with a fuel intake passage and a discharge passage, wherein a part of the plunger constitutes a part of the wall surface of the fuel pressurizing chamber; and a diaphragm type damper constituting a part of the wall surface of the above described fuel intake passage.

A fuel feed device, wherein a part of the outer surface of the above described diaphragm type damper excluding the part that constitutes part of the above described wall surface is in contact with the fuel.

A fuel feed device comprising: a plunger driven to and from by a reciprocating drive unit; a fuel pressurizing chamber in communication with a fuel intake passage and an outlet passage, wherein a part of the plunger constitutes a part of the wall surface of the fuel pressurizing chamber; and a diaphragm type damper constituting a part of the wall surface of the above described fuel discharge passage.

A fuel feed device, wherein the above described diaphragm type damper has a wave-shape cross section.

A fuel feed device, wherein the material of the above described diaphragm type damper is a metal.

A fuel feed device, wherein the above diaphragm type damper is formed by sealing up gas between two diaphragms.

A fuel feed device, wherein the above described diaphragm has a substantially convex shape in cross section and the above described diaphragm type damper is formed by connecting two of the above described diaphragms to be shaped like a convex lens.

A fuel feed device, wherein the above described diaphragm type damper is formed by connecting two diaphragms via an annular member inserted between the diaphragms.

A fuel feed device, wherein at least one of the above described two diaphragms has a wave-shape cross section.

A fuel feed device, wherein the above described diaphragm type damper is formed by welding the peripheries of the above described two diaphragms.

A fuel feed device, wherein in an atmosphere the pressure of the gas sealed up between the above described two diaphragms is not smaller than the minimum working fuel pressure of the fuel feed device and not greater than the maximum working fuel pressure of the same.

According to the present invention, it is possible to feed the fuel to a fuel injection valve at a fuel pressure with improved stability.

It should be further understood by those skilled in the art that although the foregoing description has been made on embodiments of the invention, the invention is not limited thereto and various changes and modifications may be made without departing from the spirit of the invention and the scope of the appended claims.

What is claimed is:

1. A fuel feed system for an internal combustion engine, comprising:

a fuel tank; and a low-pressure pump for feeding a fuel in said fuel tank to a fuel injection valve, wherein said fuel feed system is provided with a diaphragm type damper in which a gas is sealed up between two diaphragms, and said diaphragm is configured to be a substantially convex shape, and two of the diaphragms are connected forming a shape like a convex lens, wherein said two diaphragms are secured via an elastic member of a wavelike shape.

2. A high-pressure fuel supply pump, comprising:

a pump body having a pressurizing chamber for pressurizing a fuel;

a plunger for feeding the fuel by force in the pressurizing chamber;

an intake valve provided at a fuel inlet of the pressurizing chamber;

a discharge valve provided at a fuel outlet of said pressurizing chamber; and a low-pressure chamber provided in an upstream of said intake valve, wherein a mechanism for reducing fuel pressure pulsation is disposed in a space of a low-pressure chamber provided in the upstream of said intake valve, and a fuel pressure sensor for measuring the fuel pressure is mounted near said mechanism for reducing fuel pressure pulsation.

3. The high-pressure fuel supply pump according to claim 2, wherein said fuel pressure sensor for measuring fuel pressure is mounted on a case to which said mechanism for reducing fuel pressure pulsation is secured.

4. The high-pressure fuel supply pump according to claim 2, wherein a metal bellows type damper is used as the mechanism for reducing fuel pressure pulsation.

5. The high-pressure fuel supply pump according to claim 2, including a diaphragm type damper in which a gas is sealed up between two diaphragms, and said diaphragm is configured to be a substantially convex shape is provided as a mechanism for reducing fuel pressure pulsation, two of the diaphragms being connected forming a shape like a convex lens.

6. A high-pressure fuel supply pump for pressurizing a low-pressure fuel from a low-pressure pump to a high pressure to feed the fuel to fuel injection valves, said high-pressure fuel supply pump including a diaphragm type damper in which a gas is sealed up between two diaphragms, wherein at least one of said two diaphragms has a wave-shape cross section, and said diaphragm type damper is disposed in a low pressure chamber disposed in an upstream of an intake valve of said high-pressure fuel feed pump.

7. A high-pressure fuel supply pump according to claim 2, wherein a diaphragm type damper in which a gas is sealed up between two diaphragms is provided as a mechanism for reducing fuel pressure pulsation, and said diaphragm type damper is formed by connecting two diaphragms with an annular member inserted between the diaphragms.

8. A high-pressure fuel supply pump according to claim 2, wherein a diaphragm type damper in which a gas is sealed up between two diaphragms is provided as a mechanism for reducing fuel pressure pulsation, and at least one of said two diaphragms has a wave-shape cross section.

9. A fuel feed system far an internal combustion engine, comprising:

a fuel tank; and a low-pressure pump for feeding a fuel in said fuel tank to a fuel injection valve, wherein said fuel feed system is provided with a diaphragm type damper in which a gas is sealed up between two diaphragms, and at least one of said two diaphragms has a wave-shape cross section.

10. The fuel feed system according to claim 9 further comprising a high-pressure fuel feed pump for pressurizing a low-pressure fuel from a said low-pressure pump to a high pressure to feed the fuel to fuel injection valves wherein said diaphragm type damper is disposed in a low pressure chamber disposed in an upstream of an intake valve of said high-pressure fuel feed pump.

11. The fuel feed system according to claim 9, wherein said diaphragm is a diaphragm made of metal.

12. The fuel feed system according to claim 9, wherein a pressure of a gas to be sealed up between the two diaphragms is not smaller than a minimum working fuel pressure and not greater than a maximum working fuel pressure.

13. The fuel feed system according to claim 9, wherein a fuel chamber is provided on each surface of said two dampers.

14. A fuel feed system for an internal combustion engine, comprising:

a fuel tank; and a low-pressure pump for feeding a fuel in said fuel tank to a fuel injection valve, wherein said fuel feed system is provided with a diaphragm type damper in which a gas is sealed up between two diaphragms, and said diaphragm type damper is formed by connecting two diaphragms with an annular member inserted between the diaphragms, wherein said two dampers are secured via an elastic body of a wavelike shape.

15. The fuel feed system according to claim 9, wherein said two dampers are secured via an elastic body of a wavelike shape.

16. The fuel feed system according to claim 9, further comprising a high-pressure fuel feed pump for pressurizing a low-pressure fuel from the low-pressure pump to a high pressure to feed the fuel to fuel injection valves, wherein said diaphragm type damper is disposed in a low pressure fuel passage upstream from the high-pressure fuel feed pump.

17. The fuel feed system according to claim 9, further comprising a high-pressure fuel supply pump for pressurizing a low-pressure fuel from the low-pressure pump to a high pressure to feed the fuel to fuel injection valves, wherein said diaphragm type damper is disposed in a high-pressure fuel passage downstream from the high-pressure fuel feed pump.

18. The fuel feed system according to claim 9, wherein said two of the diaphragm type dampers are fixed to a housing using a cover, and a fuel chamber is provided inside said cover.

19. The fuel feed system according to claim 9, wherein said diaphragm type damper is formed by connecting two diaphragms with an annular member inserted between the diaphragms.

20. A high-pressure fuel supply pump according to claim 6, wherein said diaphragm type damper is formed by connecting two diaphragms with an annular member inserted between the diaphragms.

* * * * *